US006138667A

United States Patent [19]

Cakebread

[11] Patent Number: 6,138,667

[45] Date of Patent: Oct. 31, 2000

[54] DIRECT VENT FIREPLACE CONSTRUCTION

[75] Inventor: Kenneth D. Cakebread, Florence, Ala.

[73] Assignee: Temco Fireplace Products, Inc., Nashville, Tenn.

[21] Appl. No.: 09/456,970

[22] Filed: Dec. 7, 1999

[51] Int. Cl.[7] ..... F23C 1/18

[52] U.S. Cl. ..... 126/512; 126/504; 126/547; 110/173 B

[58] Field of Search ..... 126/502, 504, 126/512, 528, 530, 547, 548, 85 B; 110/173 B

[56] References Cited

U.S. PATENT DOCUMENTS

| | | | |
|---|---|---|---|
| 4,236,499 | 12/1980 | Simeone | 126/547 |
| 5,398,669 | 3/1995 | McCullough et al. | 126/512 |
| 5,471,973 | 12/1995 | Wilhoite | 126/502 |
| 5,613,487 | 3/1997 | Hawkinson | 126/512 |
| 5,715,808 | 2/1998 | Wilhoite | 126/512 |
| 5,782,231 | 7/1998 | Wade | 126/512 |
| 5,865,165 | 2/1999 | Brazier | 126/512 |

*Primary Examiner*—Ira S. Lazarus
*Assistant Examiner*—Josiah C. Cocks
*Attorney, Agent, or Firm*—Alan Ruderman; Stephen J. Stark; Miller & Martin LLP

[57] ABSTRACT

A gas fueled direct vent fireplace has a firebox within an outer casing, the firebox having a mounting plate above the floor of the casing for mounting burner support brackets, a pilot light assembly, a gas valve and control assembly, and other conventional elements for controlling the burner. The mounting plate includes an explosion blow-out valve plate and a vacuum release plate which are spring biased to close respective ports. The valve plate opens when the gas pressure within the firebox is excessive, and the vacuum release plate opens if the release of pressure from the firebox causes the firebox to become subatmospheric. The firebox has a frontal opening which is closed by a glass access door having an extrusion at upper and lower edges and side edge protectors. The extrusions have portions which face the interior of the firebox to be grasped by latches mounted on the firebox to tightly secure the glass access door to the firebox. A gasket is bonded to the surface of the glass which faces the firebox and seals the glass against the firebox.

17 Claims, 3 Drawing Sheets

DIRECT VENT FIREPLACE CONSTRUCTION

BACKGROUND OF THE INVENTION

This invention relates to a gas burning direct vent fireplace including a room facing sealed glass access door, and having the burner, substantially all of the controls and safety devices mounted on a single removable mounting plate forming the floor of the firebox, and to the mounting and sealing of the glass access door to the firebox.

In direct vent fireplaces of the type illustrated in Wilhoite, U.S. Pat. Nos. 5,471,973 and 5,715,808, and Wade, U.S. Pat. No. 5,782,231, the firebox, i.e., the combustion chamber or housing within which the hot flue gases are generated is disposed within a casing and vents through a conduit directly through an outside wall to the exterior of the building in which the fireplace is located. The firebox receives fresh air which supports combustion from an air inlet conduit in substantially that same exterior location as the exhaust conduit vent and generally concentric with the exterior exhaust vent. Room air is drawn into the front of the fireplace below the firebox, rises above the firebox over the top and exhausts at the front. As the room air flows about and over the firebox, it is heated so that it enters the room as heated air. An array of artificial logs or the like is disposed within the firebox and gas, such as natural gas or propane, may be ignited to create a flame which in conjunction with the logs simulates the aesthetics of actual burning logs.

The front of the fireplace between the location where the air enters from the room and where the heated air returns to the room generally includes an access door having a tempered or ceramic glass in the central area for viewing the flames. In the prior art, the glass access door generally comprises a metal frame disposed about the glass, the frame being sealed to the firebox in the operative position. This frame is generally mounted, as illustrated in the aforesaid U.S. Pat. Nos. 5,471,973 and 5,782,231, using spring biased bolts so that should a gas build-up occur within the firebox and result in an overpressurization or explosion therein, the springs will absorb the force and permit the frame or access panel to react outwardly thereby releasing the excessive pressure and preventing destruction of the glass. Thus, the bolts are for forcing the frame toward the firebox while the springs permit the frame to move away from the firebox.

The sealing of the frame to the firebox must provide a tight fit so as to prevent the flue gases from entering into the room. Elastomeric silicone polymer gaskets have been used in the prior art glued about the glass front, and although these gaskets provide a good seal they do not have very high temperature characteristics. As was pointed out in the U.S. Pat. No. 5,471,973, the silicone gaskets become hard and brittle and age or deteriorate rapidly. It was for this reason that it was proposed in that patent to provide a fiberglass seal about the periphery of the frontal opening of the firebox between the firebox and the glass panel access door, the seal abutting the glass and being spaced from the periphery of the glass panel, and an elastomeric silicone seal fitted about the periphery of the glass without glue was positioned about the periphery of the glass panel to seal against flue gases leaking past the fiberglass seal. In other words, two seals were provided, the first seal being about the periphery of the front of the firebox accessible directly by the flue gases and the access door having a second seal located outwardly of the first seal about the periphery of the glass panel downstream of the fiberglass seal. In the prior art, it should be clear, the gasket wrapped around the glass and provided a seal between the glass and the frame. As aforesaid, the frame itself was mounted to the firebox by the spring biased bolts and thus both the frame and the sealing arrangement was necessary to provide a tight seal and yet permit the frame and glass to move away from the firebox in the event of explosion due to a gas build-up.

Furthermore, in the prior art, the gas burner was generally mounted on a hearth fastened to the floor of the firebox with the controls mounted beneath the floor. With this construction, the hearth must be positioned on the floor and the gas burner mounted on the hearth and connected to the various valve and control elements individually for feeding gas to the burners. This provides a complex mounting assembly, wherein assembly, adjustments, repair and maintenance requires one to work in the limited space beneath the firebox floor between that floor and the floor of the outer housing of the fireplace. Although in the aforesaid Wade U.S. Pat. No. 5,782,231 a partial solution to this problem is disclosed, the limited space beneath the floor still makes maintenance difficult when one must make adjustments or repairs.

SUMMARY OF THE INVENTION

Consequently, it is a primary object of the present invention to provide in a gas fueled direct vent fireplace a simplified mounting of the burner and the gas controls and other burner components on a single plate removably attached to the remainder of the firebox, said plate being fastened to or forming the floor of the firebox.

It is another object of the present invention to provide in a gas fueled direct vent fireplace a glass access door mounting that avoids the use of a frame.

It is a further object of the present invention to provide in a gas fueled direct vent fireplace having a glass access door and a mounting plate being fastened to or forming the floor of the fireplace for mounting the burner and the gas control components thereon, the door being connected to and sealed against the firebox of the fireplace.

It is a still further object of the present invention to provide in a gas fueled direct vent fireplace a simplified mounting of the burner and the gas controls and other burner components on a single plate removably mounted to the remainder of the firebox, said plate being fastened to or forming the floor of the firebox and having an explosion release valve for relieving pressure from the firebox in the event of an explosion, and a glass access door at the front of the firebox.

It is a yet still further object of the present invention to provide in a gas fueled direct vent fireplace a simplified mounting of the burner and the gas controls and other burner components on a single plate removably mounted to the remainder of the firebox, said plate being fastened to or forming the floor of the firebox and having an explosion release valve for relieving pressure from the firebox in the event of an explosion, and a glass access door at the front of the firebox, wherein said glass access door is secured to and sealed to said firebox.

Accordingly, the present invention provides a gas fueled direct vent fireplace wherein the firebox has a mounting plate on which are directly mounted the burner support brackets, the pilot light assembly, the gas valve and control assembly, and safety assemblies for protection in the event of a gas buildup and explosion, the plate forming or being attached to the floor of the firebox which includes latches that aid in securely gripping a glass access door, against the firebox. The glass access door has a pair of extrusions at upper and lower edges and may have a mere edge protectors at the sides, the extrusions having lips which at the lower edges grasp the latches and at the upper edges grasp other latches at the top of the firebox.

The firebox mounting plate mounts the burner and the pilot assembly on the upper surface, and the gas valve and control assembly on the lower surface which is spaced above the floor of the fireplace, the mounting plate including an explosion blow-out plate and a vacuum release plate which form the safety assemblies. The blow-out plate normally is biased to close a port in the plate but moves downwardly away from the plate to open the port and exhaust high pressure gas beneath the firebox in the event of an explosion, while the vacuum release plate normally is biased to close another port in the plate and moves upwardly away from the plate to open and provide an inflow of air from beneath the firebox should the explosive gases when leaving the firebox create a sub-atmospheric pressure.

The glass access door has a seal in the form of a gasket which is bonded directly to the glass surface facing the firebox and seals against the firebox when the glass access door is grasped by the latches. Thus, the elimination of the frame and the use of the gasket directly against the glass eliminates the need to seal the glass to the frame and provides a tighter seal between the glass and the firebox.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
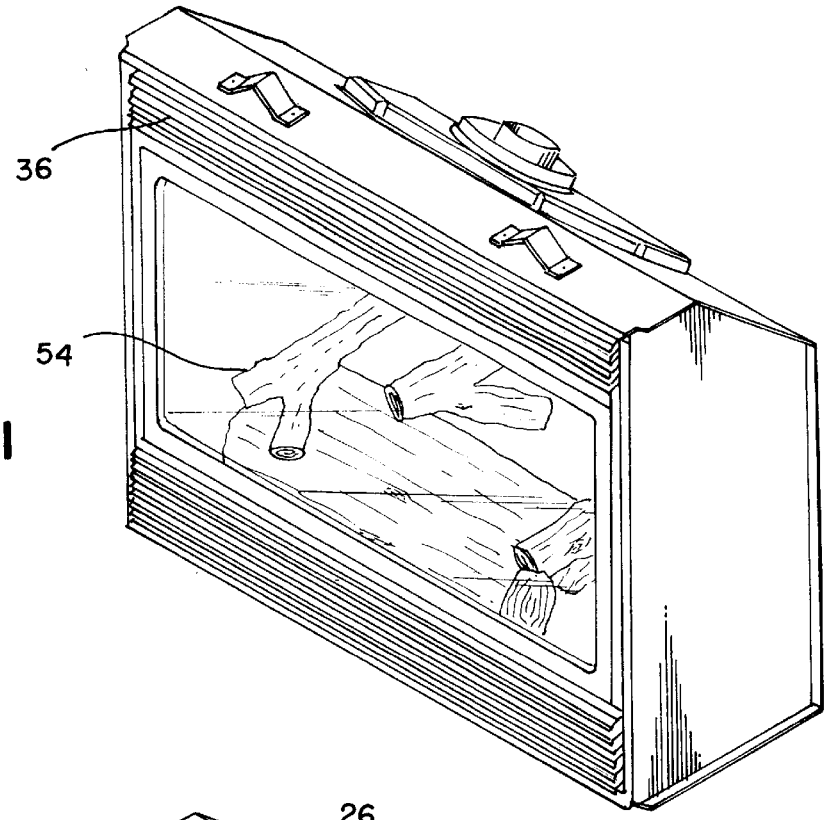
FIG. 1 is an assembled front perspective view of a fireplace having a firebox incorporating the principles of the present invention.
Figure 3:
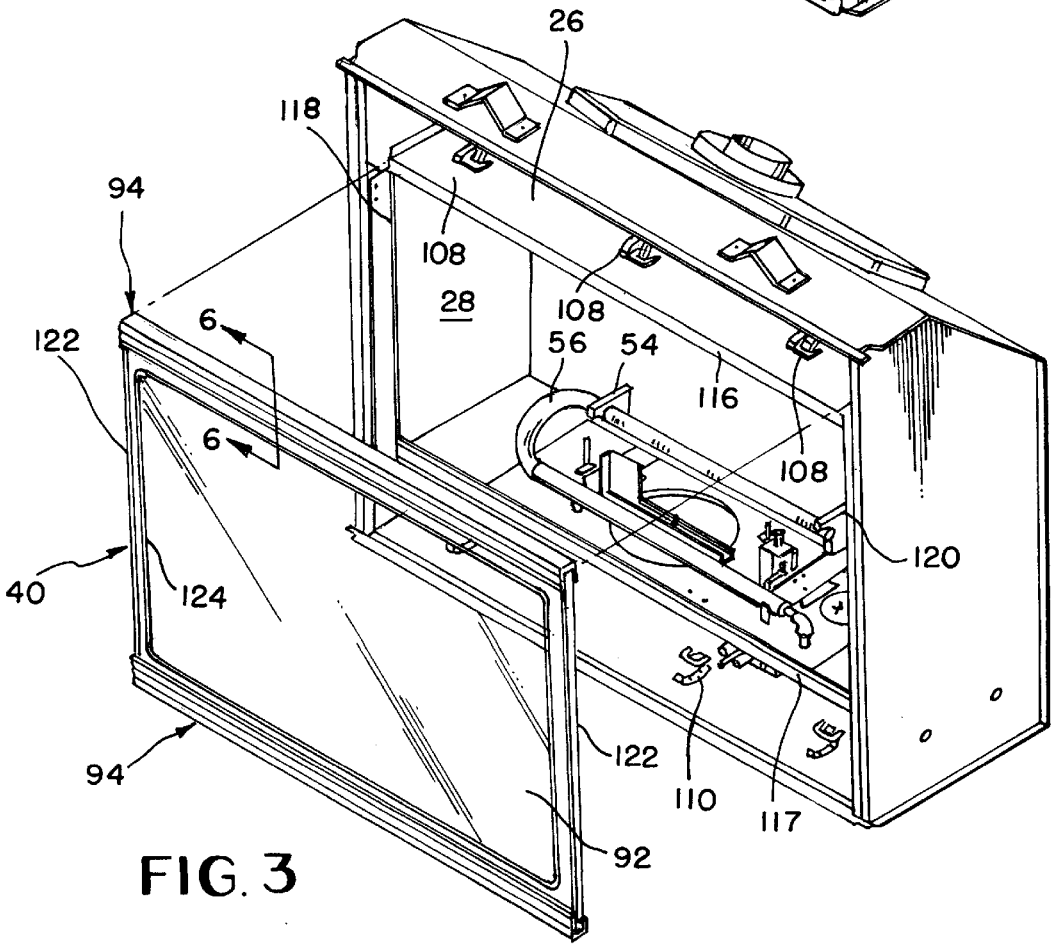
FIG. 3 is a view similar to FIG. 1 but with the glass door assembly exploded away from the firebox and with the decorative artificial logs removed.
Figure 2:
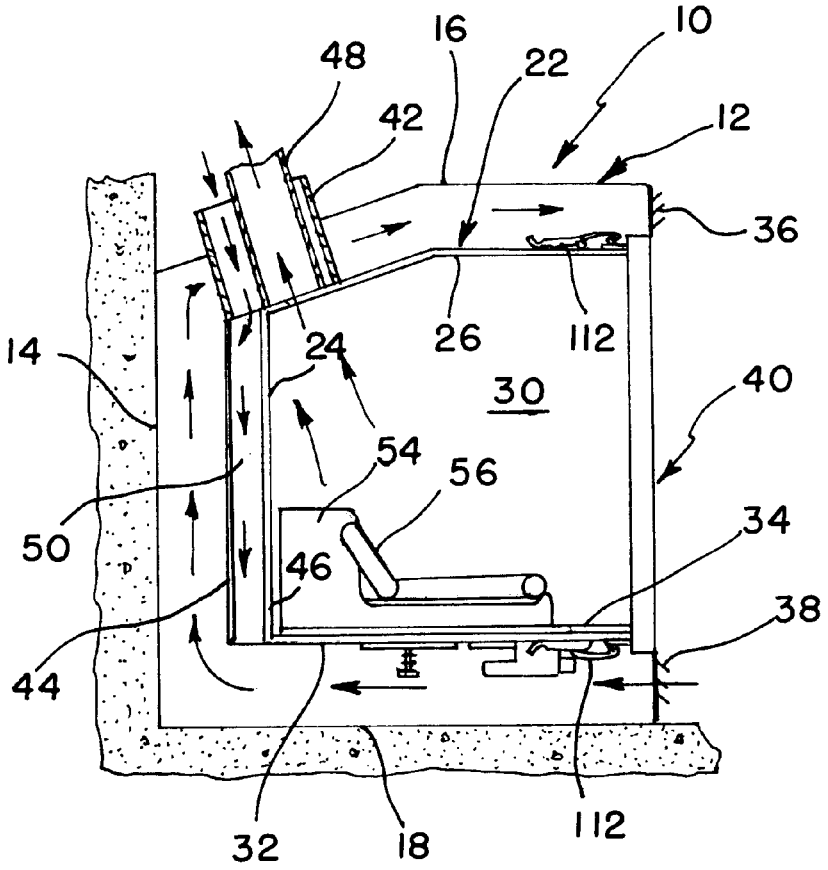
FIG. 2 is a vertical cross-sectional view taken substantially through the fireplace of FIG. 1 with the decorative logs removed.
Figure 8:
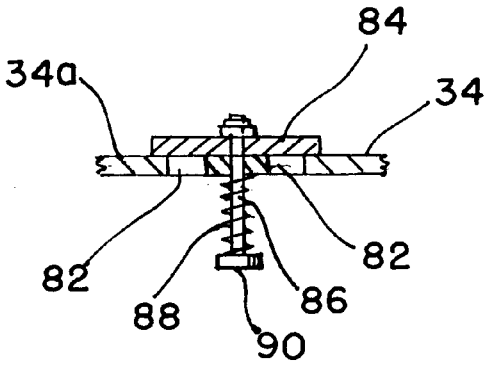
FIG. 8 is a cross-sectional view taken substantially along line 8—8 of FIG. 4.

Referring to the drawings, a direct vent fireplace 10 having a sheet metal outer casing 12 is illustrated in FIGS. 1–3, the casing 12 having a rear wall 14, a top wall 16, a bottom wall 18 and a pair of side walls 20 (only one of which is illustrated) welded, or secured by other means such as screws or stakes, together into a unit. Mounted within the fireplace outer casing is a firebox 22 in the form of a sheet metal box including a rear wall 24, a top wall 26, and side walls 28, 30 welded or otherwise mechanically sealed thereto and spaced from the respective walls of the fireplace casing. Additionally, the firebox has a floor which may comprise a bottom plate 32 welded to the rear and side walled 24 and 28, 30 spaced above the bottom wall 18 of the fireplace. Alternatively, the floor of the firebox may comprise a mounting plate 34 as hereinafter described. If the floor comprises the bottom plate 32, as in the preferred embodiment, then the mounting plate 34 is removably secured by screws to the bottom plate 32. If the floor merely comprises the mounting plate 34, then it may be removably secured by screws to the rear wall 24 and the side walls 28, 30. The description which hereinafter follows is of the preferred embodiment with the additional plate 32 forming the floor of the firebox. Moreover, the spacing between the top wall 26 of the firebox and the top wall 16 of the outer casing and the front of the fireplace is enclosed by a grill assembly 36 while a similar grill assembly 38 closes off the spacing between the bottom plate 32 of the firebox and the bottom wall 18 of the outer casing. A glass door assembly 40 as hereinafter described further closes off the front of the firebox.

Extending through the top wall 16 of the outer casing at the rear thereof is a cylindrical conduit 42 which communicates with a pair of air intake ducts 44 (only one of which is illustrated) to communicate air from the exterior of the fireplace outside the building in which the fireplace is mounted into the firebox, the intake ducts each having a respective outlet 46 at the bottom thereof for feeding the air through corresponding openings in the rear wall of the firebox into the firebox. Mounted preferably non-concentrically within the air conduit 42 is a smaller conduit 48 which communicates with the interior of the firebox 22 to receive flue gas resulting from the combustion of gas within the firebox, the exhaust duct 48 conducting the flue gas outside of the building. Thus, an air inlet channel 50 is formed by the conduit 42 and the air intake ducts 44 so that fresh air from outside the building is supplied to the firebox to support combustion, while the flue gas products of combustion exhaust through the conduit 48. Room air is received through the lower grill 38 and flows through another channel 52 around the firebox where it is heated and returned as warm air to the room through the upper grill 36.

Figure 4:
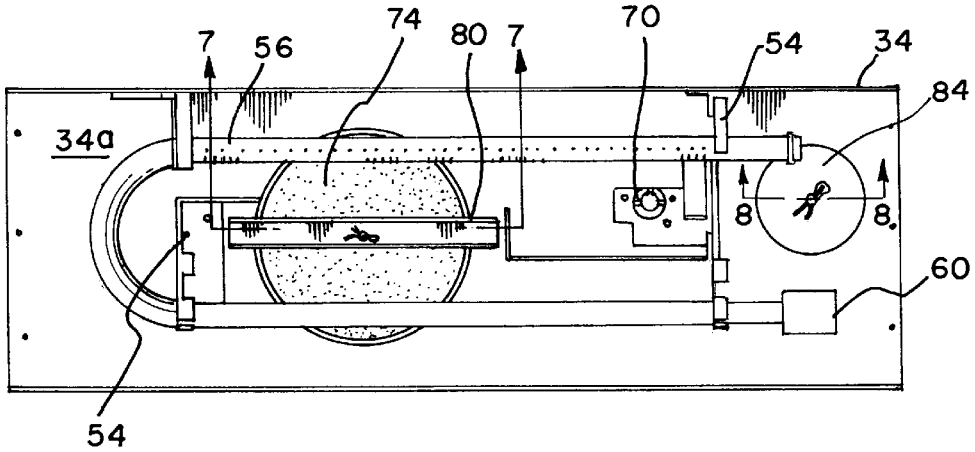
FIG. 4 is a top plan view of a mounting plate of the firebox.
Figure 5:
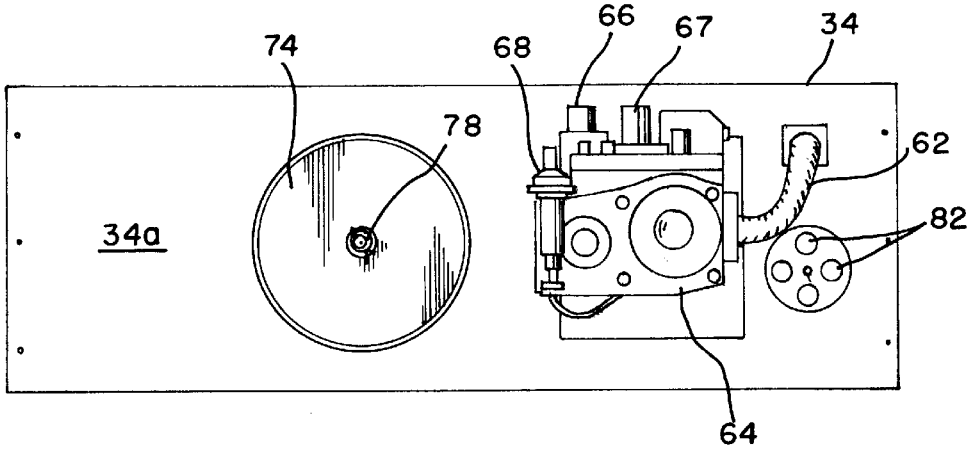
FIG. 5 is a bottom plan view of a mounting plate of the firebox.

Disposed on the upper surface 34*a* of the mounting plate 34, as illustrated in FIG. 4, are a pair of burner and log brackets 54 which support a substantially U-shaped tubular burner 56 and artificial logs 58 illustrated in FIG. 1. One end of the burner 56 is closed and the other end is connected to a coupling 60 supported on the upper surface and communicates with a gas fuel supply tube 62 extending through the plate 34 where it is connected at the lower surface 34*b* to the valve assembly 64 which is mounted on the lower surface of the plate and which carries the gas control knobs 66, 67 and is connected to the ignitor assembly 68. The pilot assembly 70 is mounted on the upper surface 34*a* but controlled by the control knob 66 while the knob 67 controls the gas flow to the burner 56 and thus the flame emitted.

Formed through the plate 34 is a first aperture 72 which is normally closed from beneath by a valve plate 74, the valve plate having a rod 75 extending therethrough in sealed relationship with the valve plate. Disposed about the rod 76 beneath the plate 34 is a coil spring 76 which is positioned between and abut the valve plate and a stop member 78. The opposite end of the rod 76 is fastened to a brace or strap 80 spinning the aperture 72 and having its ends secured to the upper surface 34*a* of the plate 34. Thus, the spring 76 normally urges the valve plate 74 into abutment with the lower surface 34*b* of the mounting plate 34 for reasons hereinafter described. A second aperture preferably having a plurality of portals 82, four of which are preferred and illustrated formed in an insert which closes the aperture, is also formed through the plate 34 spaced from the aperture 72. The portals 82 are normally closed from the upper surface by a small valve plate 84 connected to a rod 86 at the upper end, a spring 88 being disposed about the rod beneath the plate 34. The lower end of the rod has a stop member 90 for the spring so that the spring 88 urges the valve plate 84 into abutment with the upper surface 34*a* of the mounting plate 34 for reasons hereinafter described. It may be seen that a force above the plate 34 is required to open the aperture 72 and a force from beneath the plate 34 as required to open the portals 82. Thus if there is a substantial gas build-up in the firebox resulting in an explosion when the glass door assembly is installed the urging of the spring may be overcome and the valve plate 74 will then be forced downwardly to open the aperture 72 and release the pressure by permitting the gas to exit the firebox beneath the plate 34. This provides an explosion relief in the firebox. Additionally, if there is a rapid release of the gas a low pressure subatmospheric situation could result in the firebox. In this case, the valve plate 84 is drawn upwardly against the urging of the spring 88 to open the portals 82 and permit air from the room to be drawn upwardly into the firebox to release the low pressure condition. This dramatically reduces the severity of the flexation of the firebox and associated components, thereby greatly reducing the possibility of leaks and damage to parts.

Figure 6:
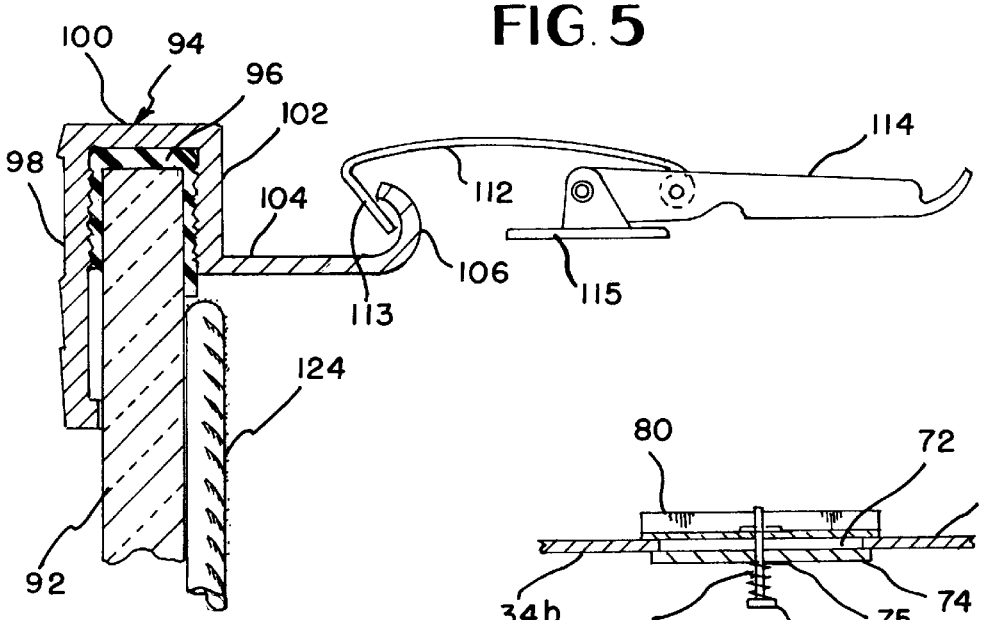
FIG. 6 is a cross-sectional view taken substantially along the line 6—6 of FIG. 3.
Figure 7:
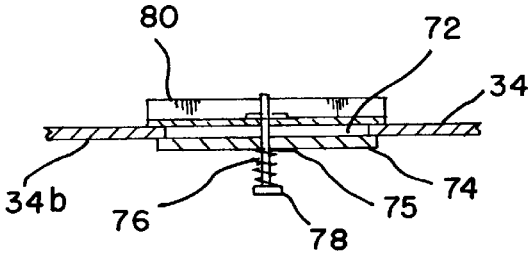
FIG. 7 is a cross-sectional view taken substantially along line 7—7 of FIG. 4.

The glass door assembly which has a rectangular configuration preferably comprises a ceramic or tempered glass panel 92 to permit the flame within the firebox to be viewed. The assembly 40 is substantially different from the prior art in that it has no frame around the glass panel. On the contrary, it merely has a metal extrusion 94 along the respective top and bottom edges, there being serrations in the interior of each extrusion with a silicone retention channel 96 for securing the metal extrusion to the edge of the glass panel as illustrated in FIG. 6. The cross sectional configuration of the extrusion as illustrated in FIG. 6 comprises a front leg 98 abutting the silicone retention channel on the front surface of the glass 92 leading to a transversely extending leg 100 abutting the seal 96 on the respective upper and lower surface. The leg 100 extends to a rear leg 102 and terminates above the lowest level of the front leg 98 along the top extrusion and below the highest level of the front leg at the bottom of the extrusion, i.e., the distal end of the leg 102 is closer to the edge of the panel than the distal end of the leg 98. The extrusion also has a second transverse leg or lip 104 extending from the distal end of the leg 102 remote from the leg 100, the lip 104 extending rearwardly and terminating with a frontwardly extending curvalinear gripping portion 106 for gripping a plurality of spaced apart latches 108, 110 at the respective top and bottom of the firebox.

Latches 108 are on the upper surface of the top wall 16 of the firebox and the latches 110 are on the lower surface of the bottom plate 32 of the firebox or the lower surface of the mounting plate 34 if the mounting plate comprises the bottom of the firebox. These latches may comprise over-center type members having a gripping member 112 having a grasping portion 113 at one end and at the other end is pivoted to a lever 114 which in turn is pivoted to the mounting portion 115 which is secured to the firebox so that the gripping member 112 may engage the gripping portion 106 of the extrusions 94. When this occurs the gripping portions 106 are pulled toward the firebox to clamp the glass door assembly against the upper, lower and side tabs 116, 117, 118, 120 respectively of the firebox, this being performed, of course, before the grill assemblies 36, 38 are installed closing the space between the firebox and the outer casing 12 above and below the firebox.

The side edges of the glass panel 92 between the extrusions 94 are merely plastic or metal edge protectors 122 which are bonded or glued to the panel 92 with retention seals therebetween. A rope type gasket 124 of fiberglass or the like as illustrated in FIG. 6, is bonded directly to the glass by an acrylic adhesive strip on the interior of the glass about the periphery so that when the glass panel 40 is clamped to the firebox a tight seal between the glass and the firebox is provided. With this construction the use of a complex wraparound seal between the glass and the frame as in the prior art is eliminated. This construction also provides a substantially lighter weight glass door assembly than the prior art. This permits easier installation and maintenance and in combination with the readily removable mounting plate 34 provides an assembly which is substantially more efficient than the prior art for assembling and maintaining the fireplace components.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed therein is:

1. A fireplace comprising a casing having a top, bottom, rear and side walls, a firebox disposed within said casing within which combustion products including flue gases are generated, said firebox having a top wall spaced from said top wall of said casing, a rear wall, a pair of side walls, and a frontal opening facing an adjoining room, a flue gas vent for venting said flue gases out said firebox remote from said frontal opening, an access door for closing said frontal opening to keep flue gases from flowing into said room, a mounting plate within said firebox spaced from said top wall of said firebox and from said bottom wall of said casing and defining a space therebetween communicating with said room, said mounting plate having brackets on an upper surface for mounting a burner, an aperture extending through said mounting plate, a valve plate, a spring normally urging said valve plate against a lower surface of said mounting plate into closing relationship with said aperture and for permitting opening of said aperture when an excessively high pressure gas is presented within said firebox to permit release of said high pressure to beneath said mounting plate and above the bottom wall of said casing.

2. A fireplace as recited in claim 1, wherein said mounting plate includes a second aperture extending therethrough, a second valve plate, a second spring normally urging said second valve plate against said upper surface of said mounting plate into closing relationship with said second aperture and for opening said second aperture when release of said high pressure gas results in a pressure in said firebox above said mounting plate which is substantially lower than atmospheric pressure to permit air at atmospheric pressure within said room to enter said firebox above said mounting plate.

3. A fireplace as recited in claim 1, wherein said access door comprises a glass plate for viewing the interior of said firebox, a pair of spaced apart extrusions at upper and lower edges of said glass plate, said extrusions each having gripping portions extending in a direction away from said room when said door is in operative position, and clamping members connected to said firebox for grasping said gripping portions to draw said access door tightly against said firebox.

4. A fireplace as recited in claim 3, wherein said mounting plate includes a second aperture extending therethrough, a second valve plate, a second spring normally urging said second valve plate against said upper surface of said mounting plate into closing relationship with said second aperture and for opening said second aperture when release of said high pressure gas results in a pressure in said firebox above said mounting plate which is substantially lower than atmospheric pressure to permit air at atmospheric pressure within said room to enter said firebox above said mounting plate.

5. A fireplace as recited in claim 3, including a gasket bonded to said glass plate on the surface of said plate facing said firebox when the door is in operative position to seal said glass plate against said firebox.

6. A fireplace as recited in claim 5, wherein said mounting plate includes a second aperture extending therethrough, a second valve plate, a second spring normally urging said second valve plate against said upper surface of said mounting plate into closing relationship with said second aperture and for opening said second aperture when release of said high pressure gas results in a pressure in said firebox above said mounting plate which is substantially lower than atmospheric pressure to permit air at atmospheric pressure within said room to enter said firebox above said mounting plate.

7. A fireplace as recited in claim 1, wherein a pilot assembly is mounted on said upper surface of said mounting plate and a gas valve assembly is mounted on the lower surface of said mounting plate for supplying gas to said pilot assembly and said burner.

8. A fireplace as recited in claim 7, wherein said mounting plate includes a second aperture extending therethrough, a second valve plate, a second spring normally urging said second valve plate against said upper surface of said mounting plate into closing relationship with said second aperture and for opening said second aperture when release of said high pressure gas results in a pressure in said firebox above said mounting plate which is substantially lower than atmospheric pressure to permit air at atmospheric pressure within said room to enter said firebox above said mounting plate.

9. A fireplace as recited in claim 7, wherein said access door comprises a glass plate for viewing the interior of said firebox, a pair of spaced apart extrusions at upper and lower edges of said glass plate, said extrusions each having gripping portions extending in a direction away from said room when said door is in operative position, and clamping members connected to said firebox for grasping said gripping portions to draw said access door tightly against said firebox.

10. A fireplace as recited in claim 9, including a gasket bonded to said glass plate on the surface of said plate facing said firebox when the door is in operative position to seal said glass plate against said firebox.

11. A fireplace comprising a casing having top, bottom, rear and side walls, a firebox disposed within said casing within which combustion products including flue gases are generated, said firebox having a top wall spaced from said top of said casing, a rear wall, a pair of side walls, and a frontal opening facing an adjoining room, a flue gas vent for venting said flue gases out said firebox remote from said frontal opening, an access door for closing said frontal opening to keep flue gases from flowing into said room, said access door including a glass plate for viewing the interior of said firebox, a pair of spaced apart extrusions at upper and lower edge of said glass plate, said extrusions having gripping portions extending in a direction toward said firebox when said door is in operative position, and clamping members connected to said firebox for grasping said gripping portions to draw said access door tightly against said firebox.

12. A fireplace as recited in claim 11, including a gasket bonded to said glass plate on the surface facing said firebox to seal said glass plate against said firebox.

13. A fireplace as recited in claim 11, wherein said extrusions comprise a first elongated leg overlaying the surface of said glass plate facing the room, a second elongated leg overlaying the surface of said glass plate facing said firebox, a third elongated leg integral with said first and second legs and connecting said first and second legs together, said second leg having a distal end terminating at a location closer to said third leg than the distal end of said first leg terminates from said second leg, and each gripping portion extending from the terminal portion of said second leg.

14. A fireplace as recite in claim 13, including a gasket bonded to said glass plate on the surface facing said firebox to seal said glass plate against said firebox.

15. A fireplace as recited in claim 14, wherein side edges of said glass plate comprise edge protectors, and said gasket extends about the periphery of said glass plate adjacent said edge protectors and said distal end of said second leg of said extrusions.

16. A fireplace comprising a casing having a top, bottom, rear and side walls, a firebox disposed within said casing within which combustion products including flue gases are generated, said firebox having a top wall spaced from said top wall of said casing, a rear wall, a pair of side walls, and a frontal opening facing an adjoining room, a flue gas vent for venting said flue gases out said firebox remote from said frontal opening, an access door for closing said frontal opening to keep flue gases from flowing into said room, a mounting plate within said firebox spaced from said top wall of said firebox and from said bottom wall of said casing and defining a space therebetween communicating with said room, said mounting plate having brackets on an upper surface for mounting a burner, an aperture extending through said mounting plate, a valve plate, a spring normally urging said valve plate against a lower surface of said mounting plate into closing relationship with said aperture and for permitting opening of said aperture when an excessively high pressure gas is presented within said firebox to permit release of said high pressure to beneath said mounting plate and above the bottom wall of said casing, a main burner lighting member mounted on said upper surface of said mounting plate, and a gas valve assembly mounted on the lower surface of said mounting plate for supplying gas to said burner.

17. A fireplace as recited in claim 16, wherein said mounting plate includes a second aperture extending therethrough, a second valve plate, a second spring normally urging said second valve plate against said upper surface of said mounting plate into closing relationship with said second aperture and for opening said second aperture when release of said high pressure gas results in a pressure in said firebox above said mounting plate which is substantially lower than atmospheric pressure to permit air at atmospheric pressure within said room to enter said firebox above said mounting plate.

* * * * *